United States Patent [19]

Towner

[11] Patent Number: 4,906,214

[45] Date of Patent: Mar. 6, 1990

[54] MARINE PROPULSION DEVICE LOW-SPEED EXHAUST SYSTEM

[75] Inventor: Stephen J. Towner, Libertyville, Ill.

[73] Assignee: Outboard Marine Corporation, Waukegan, Ill.

[21] Appl. No.: 106,118

[22] Filed: Oct. 7, 1987

[51] Int. Cl.[4] ..... B63H 21/32

[52] U.S. Cl. ..... 440/89; 440/76

[58] Field of Search ..... 440/76, 77, 78, 89

[56] References Cited

U.S. PATENT DOCUMENTS

| | | | |
|---|---|---|---|
| 3,045,423 | 7/1962 | Hulsebus . | |
| 3,198,162 | 8/1965 | Larsen | 115/17 |
| 3,282,373 | 7/1965 | Gazzara | 181/39 |
| 3,296,997 | 1/1967 | Hoiby et al. | 115/5 |
| 3,310,022 | 3/1967 | Kollman | 115/17 |
| 3,350,879 | 11/1967 | Boda et al. | 60/31 |
| 3,520,270 | 7/1970 | Miller | 115/17 |
| 3,577,952 | 5/1971 | Tado | 115/17 |
| 3,911,852 | 10/1975 | Miller et al. | 115/17 |
| 3,967,446 | 7/1976 | Harralson et al. | 60/312 |
| 4,019,456 | 4/1977 | Harbert | 115/73 |
| 4,036,162 | 7/1977 | Maier et al. | 115/17 |
| 4,145,988 | 3/1979 | Harada | 115/73 |
| 4,303,401 | 12/1981 | Sanmi et al. | 440/88 |
| 4,354,849 | 10/1982 | Sanmi et al. | 440/88 |
| 4,421,490 | 12/1983 | Nakahama | 440/89 |
| 4,507,092 | 3/1985 | Hall et al. | 440/89 |
| 4,583,953 | 4/1986 | Nakase | 440/89 |
| 4,589,852 | 5/1986 | Price | 440/89 |
| 4,604,069 | 8/1986 | Taguchi | 440/88 |
| 4,607,723 | 8/1986 | Okazaki | 181/272 |
| 4,668,199 | 5/1987 | Freund et al. | 440/89 |

*Primary Examiner*—Sherman D. Basinger
*Assistant Examiner*—Thomas J. Brahan
*Attorney, Agent, or Firm*—Michael, Best & Friedrich

[57] ABSTRACT

A marine propulsion device comprising an engine including an exhaust outlet, a lower unit including a high-speed exhaust outlet and a rotatably mounted propeller driven by the engine, a generally vertical conduit communicating with the high-speed exhaust outlet, a wall surrounding the conduit and defining a water jacket between the wall and the conduit, the water jacket including a lower portion filled with water, a foward portion, and an exhaust gas inlet located above the level of the water and communicating with the engine exhaust outlet, and an adaptor connecting the engine to the lower unit, the adaptor including a first passage communicating between the engine exhaust outlet and the conduit, a port located forwardly of the passage and communicating with the forward portion of the water jacket at a point above the level of the water in the water jacket, a low-speed exhaust cutlet located rearwardly of the first passage, and a second passage extending interiorly of the adaptor and communicating between the port and the low-speed exhaust outlet.

20 Claims, 2 Drawing Sheets

MARINE PROPULSION DEVICE LOW-SPEED EXHAUST SYSTEM

BACKGROUND OF THE INVENTION

The invention relates to exhaust systems for marine propulsion devices, and, more particularly, to low-speed exhaust systems for marine propulsion devices.

Marine propulsion device exhaust gases are typically discharged underwater, with the exhaust gases flowing downwardly through the lower unit and then out through the propeller. At relatively high boat speeds, a low pressure region exists behind the propeller and exhaust gases are easily discharged through the propeller. At engine idle or relatively low boat speeds, water backs up into the exhaust gas passageway and creates a back pressure which restricts or prevents the discharge of exhaust gases through the propeller.

Exhaust systems have been provided for discharging exhaust gases through a discharge outlet located above the water when the engine is operating at relatively low speeds. Examples of such systems are disclosed in U.S. Wenstadt patent application No. 754,534, filed July 12, 1985, U.S. Binversie et al. patent application No. 058,365, filed June 4, 1987, and U.S. Broughton et al. patent application No. 062,435, filed June 12, 1987, all of which are assigned to the assignee of this application.

Attention is also directed to the following U.S. Patents:

| Patentee | U.S. Pat. No. | Issue Date |
|---|---|---|
| Hulsebus | 3,045,423 | July 24, 1962 |
| Larsen | 3,198,162 | August 3, 1965 |
| Gazzara | 3,282,373 | November 1, 1966 |
| Hoiby et. al. | 3,296,997 | January 10, 1967 |
| Kollman | 3,310,022 | March 21, 1967 |
| Boda et al. | 3,350,879 | November 7, 1967 |
| Miller | 3,520,270 | July 14, 1970 |
| Tado | 3,577,952 | May 11, 1971 |
| Miller et al. | 3,911,852 | October 14, 1975 |
| Harralson et al. | 3,967,446 | July 6, 1976 |
| Maier et al. | 4,036,162 | July 19, 1977 |
| Harbert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Hall et al. | 4,507,092 | March 26, 1985 |
| Price | 4,589,852 | May 20, 1986 |
| Taguchi | 4,604,069 | August 5, 1986 |
| Okazaki | 4,607,723 | August 26, 1986 |
| Freund et al. | 4,668,199 | May 26, 1987 |

Attention is also directed to the following Japanese patent applications: Application No. 54-25059, filed Mar. 6, 1979; Application No. 55-133541, filed Sept. 25, 1980; Application No. 55-155500, filed Nov. 5, 1980; Application No. 55-156562, filed Nov. 7, 1980; and Application No. 57-68908, filed Apr. 24, 1982.

SUMMARY OF THE INVENTION

The invention provides a marine propulsion device comprising an engine including an exhaust outlet, a lower unit including a high-speed exhaust outlet and a rotatably mounted propeller driven by the engine, a generally vertical conduit communicating with the high-speed exhaust outlet, wall means surrounding the conduit and defining a water jacket between the wall means and the conduit, the water jacket including a lower portion filled with water, a forward portion, and an exhaust gas inlet communicating with the engine exhaust outlet, and an adaptor connecting the engine to the lower unit, the adaptor including a first passage communicating between the engine exhaust outlet and the conduit, a second exhaust inlet located forwardly of the passage and communicating with the forward portion of the water jacket at a point above the level of the water in the water jacket, a low speed exhaust outlet located rearwardly of the first passage, and a second passage extending interiorly of the adaptor and communicating between the second exhaust inlet and the low-speed exhaust outlet.

The invention also provides an adaptor for an outboard motor including a lower unit, and an engine having an exhaust outlet, the adaptor having forward and rearward ends and comprising an upper face adapted to be connected to the engine and having therein a first exhaust inlet adapted to communicate with the engine exhaust outlet, a lower face adapted to be connected to the lower unit and having therein a first exhaust outlet, and a second exhaust inlet located forwardly of the first exhaust outlet, a first passage extending interiorly of the adaptor and communicating between the first inlet and the first outlet, a second exhaust outlet located rearwardly of the first exhaust outlet, and a second passage extending interiorly of the adaptor and communicating between the second inlet and the second outlet.

The invention also provides an adaptor for an outboard motor including a lower unit, and an engine having an exhaust outlet, the adaptor comprising an upper face adapted to be connected to the engine, a lower face adapted to be connected to the lower unit and having therein an exhaust inlet port, the exhaust inlet port having an area and being adapted to communicate with the engine exhaust outlet, an exhaust outlet port, and a passage communicating between the exhaust inlet port and the exhaust outlet port and including an interior portion having an area greater than the area of the exhaust inlet port.

The invention also provides an adaptor for an outboard motor including a lower unit, and an engine having an exhaust outlet, the adaptor comprising an upper face adapted to be connected to the engine, a lower face adapted to be connected to the lower unit, and muffler means including an exhaust inlet port located in the lower face and adapted to communicate with the engine exhaust outlet, an exhaust outlet port, and a passage communicating between the inlet port and the outlet port and having therein an expansion chamber.

The invention also provides a marine propulsion device comprising a lower unit including a high-speed exhaust outlet and a rotatably mounted propeller, a generally vertical conduit communicating with the high-speed exhaust outlet, wall means surrounding the conduit and defining a water jacket between the wall means and the conduit, the water jacket including a lower portion filled with water, a forward portion, and an exhaust gas inlet, and an engine drivingly connected to the propeller and comprising an engine block member, the engine block member including a first exhaust outlet communicating with the conduit and with the water jacket exhaust gas inlet, a first exhaust passage communicating with the first exhaust outlet, a second exhaust inlet located forwardly of the first exhaust outlet and communicating with the forward portion of the water jacket at a point above the level of the water in the water jacket, a low-speed exhaust outlet located rearwardly of the first exhaust outlet, and a second passage extending interiorly of the engine block member and communicating between the second exhaust inlet and the low-speed exhaust outlet.

The invention also provides a marine propulsion device comprising a lower unit including a high-speed exhaust outlet and a rotatably mounted propeller, a generally vertical conduit communicating with the high-speed exhaust outlet, wall means surrounding the conduit and defining a water jacket between the wall means and the conduit, the water jacket including a lower portion filled with water, and an exhaust gas inlet, and an engine drivingly conected to the propeller and comprising an engine block member, the engine block member including a lower face connected to the lower unit, the lower face having therein a first exhaust outlet communicating with the conduit and with the water jacket exhaust gas inlet, and an exhaust inlet port having an area and communicating with the water jacket at a point above the level of the water in the water jacket, a first exhaust passage communicating with the first exhaust outlet, an exhaust outlet port, and a passage communicating between the exhaust inlet port and the exhaust outlet port and including an interior portion having an area greater than the area of the exhaust inlet port.

The invention also provides a marine propulsion device comprising a lower unit including a high-speed exhaust outlet and a rotatably mounted propeller, a generally vertical conduit communicating with the high-speed exhaust outlet, wall means surrounding the conduit and defining a water jacket between the wall means and the conduit, the water jacket including a lower portion filled with water, and an exhaust gas inlet, and an engine drivingly connected to the propeller and comprising an engine block member, the engine block member including a lower face connected to the lower unit, the lower face having therein a first exhaust outlet communicating with the conduit and with the water jacket exhaust gas inlet, and the engine block member also including muffler means including an exhaust inlet port located in the lower face and communicating with the water jacket at a point above the level of the water in the water jacket, an exhaust outlet port, and a second passage communicating between the exhaust inlet port and the exhaust outlet port and having therein an expansion chamber.

A principal feature of the invention is the provision of an adaptor comprising forward and rearward ends, an upper face adapted to be connected to an engine and having therein a first exhaust inlet, a lower face adapted to be connected to a lower unit and having therein a first exhaust outlet, and a second exhaust inlet located forwardly of the first exhaust outlet, a first passage extending interiorly of the adaptor and communicating between the first inlet and the first outlet, a second outlet located rearwardly of the first exhaust outlet, and a second passage extending interiorly of the adaptor and communicating between the second inlet and the second outlet.

Another principal feature of the invention is the provision of an adaptor including muffler means, the muffler means including an exhaust inlet port in the lower face of the adaptor, an exhaust outlet port, and a passage communicating between the inlet port and the outlet port and having therein an expansion chamber. Unlike prior adaptor constructions, this construction provides additional silencing of idle exhaust gases before they are discharged.

Other principal features and advantages of the invention will become apparent to those skilled in the art upon review of the following detailed description, claims, and drawings.

Figure 1:
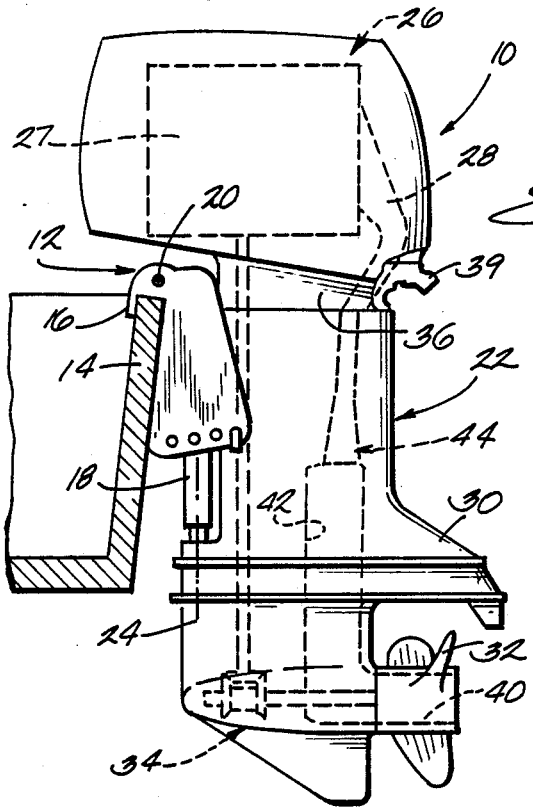
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. While the illustrated marine propulsion device 10 is an outboard motor, it should be understood that the invention is applicable to other types of marine propulsion devices, such as stern drive units.

As shown in FIG. 1, the marine propulsion device 10 comprises a mounting assembly 12 mounted on the transom 14 of a boat. While various suitable mounting assemblies can be employed, in the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24. The propulsion unit 22 has forward and rearward ends (left and right in FIG. 1) and includes an internal combustion engine 26. The engine 26 includes an upper engine block member 27 having therein an exhaust outlet 28. The engine 26 further includes an adaptor or lower engine block member 36. The adaptor 36 has forward and rearward ends and includes an upper face 37 connected to the upper engine block member 27, a lower face 38 and a side face 39 extending between the lower face 38 and the upper face 37. The adaptor 36 also includes an exhaust inlet 41 located in the adaptor upper face 37 and communicating with the engine exhaust outlet 28, an exhaust outlet 43 located in the adaptor lower face 38, and a generally vertical exhaust passage 50 extending interiorly of the adaptor 36 and communicating between the inlet 41 and the outlet 43. The propulsion unit 22 also includes a lower unit 30 which is connected to the lower face 38 of the adaptor 36 and which includes a rotatably mounted propeller 32 driven by the engine 26 via a conventional drive train 34.

It should be understood that in alternative embodiments the upper and lower engine block members 27 and 36 could be an integral or unitary member.

The marine propulsion device 10 also comprises a high-speed exhaust outlet 40 in the propeller 32, and means communicating between the adaptor exhaust outlet 43 and the high-speed exhaust outlet 40. While various suitable means can be used, in the illustrated construction, this means includes a lower exhaust passageway 42 located in the lower unit 30 and communicating with the high-speed exhaust oultet 40, and an inner housing or conduit or "megaphone" 44 located within the lower unit 30 and having an upper end communicating with the adaptor exhaust outlet 43 and a lower end communicating with the lower exhaust passageway 42. The inner housing 44 includes a conduit portion 45 which communicates between the outlet 43 and the passageway 42, and an integral plate portion 47 which supports the conduit portion 45 and which is mounted on the lower face 38 of the adaptor 36. Thus, the engine exhaust outlet 28 is connected to the high-speed exhaust outlet 40 via the adaptor inlet 41, the adaptor exhaust passage 50, the adaptor oultet 43, the inner housing 44, and the lower exhaust passage 42.

In order to cool the inner housing 44 and the exhaust gases therein, the marine propulsion device 10 further comprises wall means 52 surrounding the inner housing 44 and defining a water jacket or annular chamber 54 between the wall means 52 and the inner housing 44. In the preferred embodiment, the wall means 52 includes the outer wall of the lower unit 30. The level 64 of the water is controlled by a dam or weir 66 over which the water jacket 54 communicates with the upper end of a duct 68 having a lower end which discharged underwater. The water in the water jacket 54 can be provided by any suitable means. In the preferred embodiment, water is discharged from the engine water jacket (not shown) to the water jacket 54. In alternative embodiments, water can be pumped from outside the lower unit 30 directly into the water jacket 54.

Figure 2:
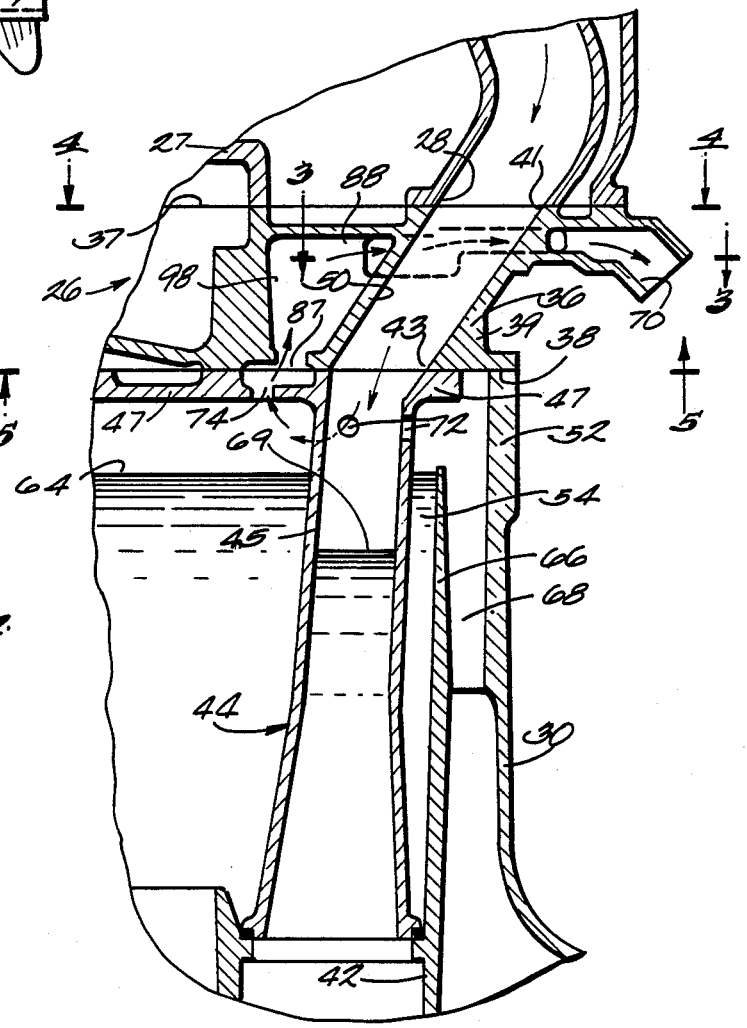
FIG. 2 is an enlarged, partial, sectional view of the device.

As explained previously, exhaust gases are easily discharged through the high-speed exhaust outlet 40 when the engine 26 is operating at relatively high speeds. When the engine 26 is operating at relatively low speeds, water backs up into the inner housing 44 and restricts or prevents discharge of exhaust gases through the high-speed exhaust outlet 40. The level 69 of the backed up water is shown in FIG. 2. Therefore, the marine propulsion device 10 further comprises means for discharging exhaust gases above the water when the engine 26 is operating at relatively low speeds. The means for discharging exhaust gases above water includes a low-speed exhaust outlet or outlet port 70 which, in the preferred embodiment, is located in the side face 39 of the adaptor 36 at the rearward end of the adaptor 36, and means communicating between the engine exhaust outlet 28 and the low-speed exhaust outlet 70.

The means communicating between the engine exhaust outlet 28 and the low-speed exhaust outlet 70 includes a plurality of openings 72 which are located in the conduit portion 45 of the inner housing 44 and which constitute exhaust gas inlets in the water jacket 54, either above or below the water level therein. Preferably, the openings 72 are located above the level 64 of the water in the water jacket 54, and exhaust gases flow through the openings 72 into the portion of the water jacket 54 above the water level 64, i.e., the upper portion of the water jacket 54.

Figure 3:
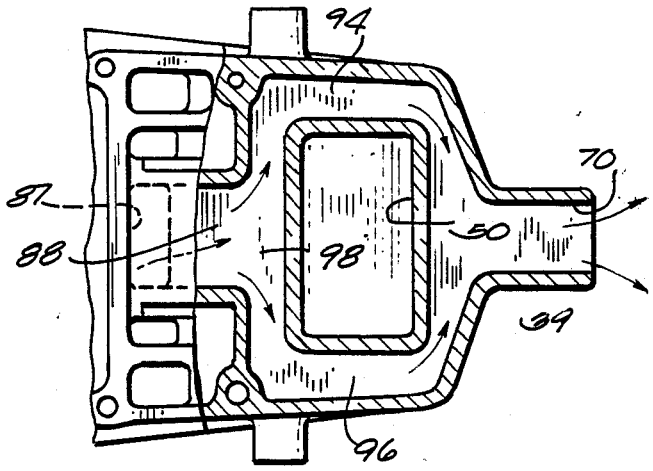
FIG. 3 is a view taken along line 3—3 in FIG. 2.
Figure 4:
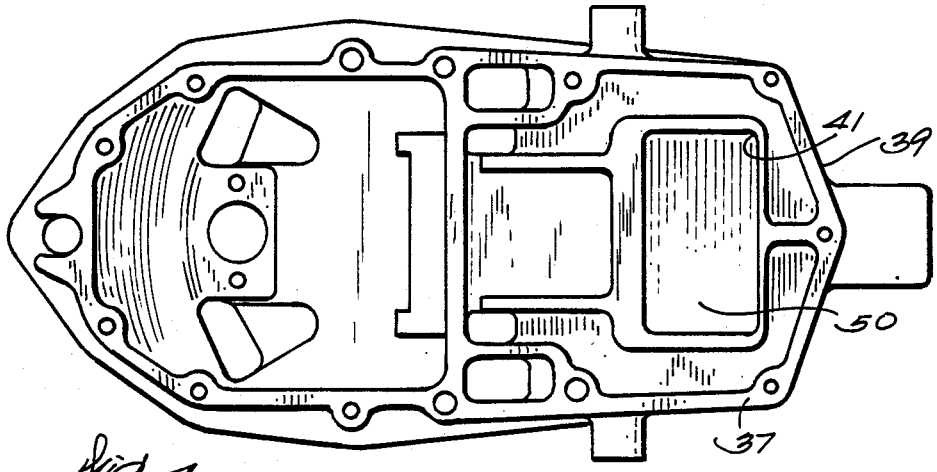
FIG. 4 is a view taken along line 4—4 in FIG. 2.
Figure 5:
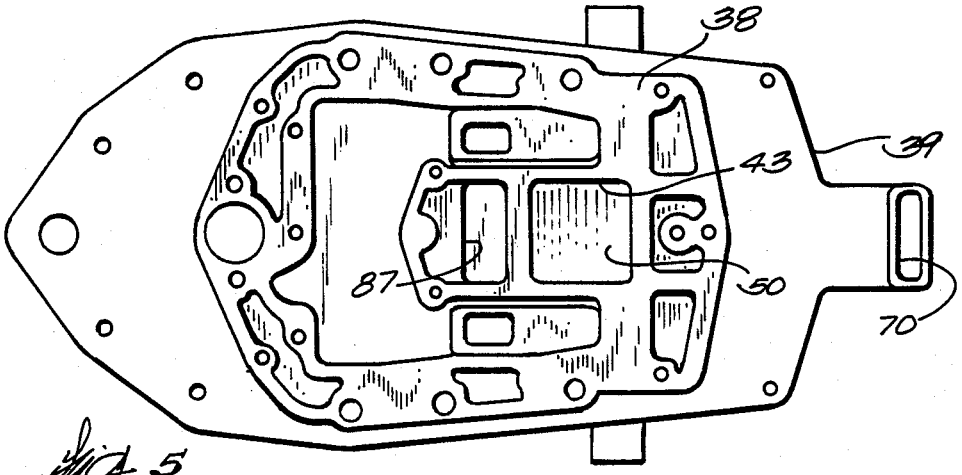
FIG. 5 is a view taken along line 5—5 in FIG. 2.

The means communicating between the engine exhaust outlet 28 and the low-speed exhaust outlet 70 also includes means communicating between the upper portion of the water jacket 54 and the low-speed exhaust outlet 70. While various suitable means can be employed, in the preferred embodiment, this means includes, in the plate portion 47 of the inner housing 44, a port 74, and, in the adaptor 36, an exhaust inlet or inlet port 87 located in the adaptor lower face 38 and located forwardly of the outlet 43, and a second passage 88 wholly defined by and located within the adaptor 36 and communicating between the adaptor inlet 87 and the low-speed exhaust outlet 70. As best shown in FIGS. 2 and 3, the passage 88 has a forward end which communicates with the inlet 87, and a rearward end which communicates with the low-speed exhaust outlet 70. Intermediate its forward and rearward ends, the passage 88 includes branches 94 and 96 passing around the opposite sides of the exhaust passage 50. Preferably, the adaptor 36 is manufactured by the lost foam casting process which permits the formation of internal passages such as the second passage 88.

In the preferred embodiment, the adaptor 36 includes muffler means which includes, in the passage 88, an interior portion or expansion chamber 98 having a cross-sectional area considerably greater than the cross-sectional area of the inlet 87.

The low-speed exhaust system operates as follows. When the engine 26 is operating at relatively low speeds, water backed up in the inner housing 44 prevents discharge of exhaust gases through the high-speed exhaust outlet 40. Therefore, exhaust gases flow through the openings 72 into the upper portion of the water jacket 54. From the water jacket 54, the exhaust gases flow through the outlet 74, through the adaptor inlet 87, through the adaptor passage 88, and out the low-speed exhaust outlet 70. This is shown by the arrows in FIG. 2.

Various features of the invention are set forth in the following claims.

I claim:

1. A marine propulsion device comprising an engine including an exhaust outlet, a lower unit including a high-speed exhaust outlet, a generally vertical conduit communicating with said high-speed exhaust outlet, wall means surrounding said conduit and defining a water jacket between said wall means and said conduit, said water jacket including a lower portion adapted to be filled with water, a forward portion, and an exhaust gas inlet communicating with said engine exhaust outlet, and an adaptor connecting said engine to said loer unit, said adaptor including a first passage communicating between said engine exhaust outlet and said conduit, a second exhaust inlet located forwardly of said passage and communicating with said forward portion of said water jacket at a point above the level of the water in said water jacket, a low-speed exhaust outlet located rearwardly of said first passage, and a second passage extending interiorly of said adaptor and communicating between said second exhaust inlet and said low-speed exhaust outlet.

2. A marine propulsion device as set forth in claim 1 wherein said first passage has opposite sides, and wherein said second passage includes first and second branches extending on said opposite sides of said first passage.

3. A marine propulsion device as set forth in claim 1 wherein said exhaust gas inlet is located above the level of the water in said water jacket.

4. A marine propulsion device as set forth in claim 1 wherein said exhaust gas inlet includes an opening in said vertical conduit.

5. A marine propulsion device as set forth in claim 1 wherein said second exhaust inlet has an area, and wherein said second passage includes an interior portion having an area greater than the area of said second exhaust inlet.

6. An adaptor for an outboard motor including a lower unit, and an engine having an exhaust outlet, said adaptor having forward and rearward ends and comprising an upper face adapted to be connected to the engine and having therein a first exhaust inlet adapted to communicate with the engine exhaust outlet, a lower face adapted to be connected to the lower unit and having therein a first exhaust outlet, and a second exhaust inlet located forwardly of said first exhaust outlet, a first passage extending interiorly of said adaptor and communicating between said first inlet and said first outlet, a second exhaust outlet located rearwardly of said first exhaust outlet, and a second passage extending interiorly of said adaptor and communicating between said second inlet and said second outlet.

7. An adaptor as set forth in claim 6 wherein said first passage has opposite sides, and wherein said second passage includes first and second branches extending on said opposite sides of said first passage.

8. An adaptor as set forth in claim 6 wherein said second exhaust inlet has an area, and wherein said second passage includes an interior portion having an area greater than the area of said second exhaust inlet.

9. An adaptor for an outboard motor including a lower unit, and an engine having an exhaust outlet, said adaptor comprising an upper face adapted to be connected to the engine, a lower face adapted to be connected to the lower unit and having therein an exhaust inlet port, said exhaust inlet port having an area and being adapted to communicate with the engine exhaust outlet, an exhaust outlet port, and a passage wholly defined by and located within said adapter, communicating between said exhaust inlet port and said exhaust outlet port, and including an interior portion having an area greater than the area of said exhaust inlet port.

10. An adaptor for an outboard motor including a lower unit, and an engine having an exhaust outlet, said adaptor comprising an upper face adapted to be connected to the engine and including therein a first exhaust inlet port adapted to communicate with the engine exhaust outlet, said adaptor also including a lower face adapted to be connected to the lower unit and having therein a second exhaust inlet port having an area and being adapted to communicate with the engine exhaust outlet, said lower face also including therein a a first exhaust outlet port, and said adaptor also including a second exhaust outlet port, a first passage communicating between said first exhaust inlet port and said first exhaust outlet port, and a second passage extending interiorly of said adaptor and communicating between said second exhaust inlet port and said second outlet port and including an interior portion having an area greater than the area of said second exhaust inlet port.

11. An adaptor as set forth in claim 10 wherein said second passage has opposite sides, and wherein said first passage includes first and second branches extending on said opposite sides of said second passage.

12. An adaptor for an outboard motor including a lower unit, and an engine having an exhaust outlet, said adaptor comprising an upper face adapted to be connected to the engine, a lower face adapted to be connected to the lower unit, and muffler means including an exhaust inlet port located in said lower face and adapted to communicate with the engine exhaust outlet, an exhaust outlet port, and a passage wholly defined by and located within said adapter, communicating between said exhaust inlet port and said exhaust outlet port, and having therein an expansion chamber.

13. An adaptor for an outboard motor including a lower unit, and an engine having an exhaust outlet, said adaptor comprising an upper face adapted to be connected to the engine and including therein a first exhaust inlet port adapted to communicate with the engine exhaust outlet, a lower face adapted to be connected to the lower unit and having, therein a first exhaust outlet port, and said adaptor further comprising muffler means including a second exhaust inlet port located in said lower face and adapted to communicate with the engine exhaust outlet, a second exhaust outlet port, a first passage extending interiorly of said adaptor and communicating between said first exhaust inlet port and said first outlet port, and a second passage communicating between said second exhaust inlet port and said second exhaust outlet port and having therein an expansion chamber.

14. A marine propulsion device comprising a lower unit including a high-speed exhaust outlet, a generally vertical conduit communicating with said high-speed exhaust outlet, wall means surrounding said conduit and defining a water jacket between said wall means and said conduit, said water jacket including a lower portion adapted to be filled with water, a forward portion, and an exhaust inlet, and an engine comprising an engine block member including a first exhaust outlet communicating with said conduit and with said water jacket exhaust inlet, a first exhaust passage communicating with said first exhaust outlet, a second exhaust inlet located forwardly of said first exhaust outlet and communicating with said forward portion of said water jacket at a point above the level of the water in said water jacket, a low-speed exhaust outlet located rearwardly of said first exhaust outlet, and a second exhaust passage extending wholly interiorly of said engine block member and communicating between said second exhaust inlet and said low-speed exhaust outlet.

15. A marine propulsion device comprising a lower unit including a high-speed exhaust outlet and a rotatably mounted propeller, a generally vertical conduit communicating with said high-speed exhaust outlet, wall means surrounding said conduit and defining a water jacket between said wall means and said conduit, said water jacket including a lower portion filled with water, a forward portion, and an exhaust gas inlet, and an engine drivingly connected to said propeller and comprising an engine block member, said engine block member including a first exhaust outlet communicating with said conduit and with said water jacket exhaust gas inlet, a first exhaust passage communicating with said first exhaust outlet and including, opposite sides, a second exhaust inlet located forwardly of said first exhaust outlet and communicating with said forward portion of said water jacket at a point above the level of the water in said water jacket, a low-speed exhaust outlet located rearwardly of said first exhaust outlet, and a second passage extending interiorly of said engine block member, communicating between said second exhaust inlet and said low-speed exhaust outlet, and including first and second branches extending on said opposite sides of said first passage.

16. A marine propulsion device comprising a lower unit including a high-speed exhaust outlet and a rotatably mounted propeller, a generally vertical conduit communicating with said high-speed exhaust outlet, wall means surrounding said conduit and defining a water jacket between said wall means and said conduit, said water jacket including a lower portion filled with water, a forward portion, and an exhaust gas inlet, and an engine drivingly connected to said propeller and comprising an engine block member including a first exhaust outlet communicating with said conduit and with said water jacket exhaust gas inlet, a first exhaust passage communicating with said first exhaust outlet, a second exhaust inlet located forwardly of said first exhaust outlet, communicating with said forward portion of said water jacket at a point above the level of the water in said water jacket, and having an area, a low-speed exhaust outlet located rearwardly of said first exhaust outlet, and a second passage extending interiorly of said engine block member, communicating between said second exhaust inlet and said low-speed exhaust outlet, and including an interior portion having an area greater than the area of said second exhaust inlet.

17. A marine propulsion device comprising a lower unit including a high-speed exhaust outlet, a generally vertical conduit communicating with said high-speed exhaust outlet, wall means surrounding said conduit and defining a water jacket between said wall means and said conduit, said water jacket including a lower portion filled with water, and an exhaust gas inlet, and an engine comprising an engine block member including a lower face connected to said lower unit, said lower face having therein a first exhaust outlet communicating with said conduit and with said water jacket exhaust gas inlet, and an exhaust inlet port having an area and communicating with said water jacket at a point above the level of the water in said water jacket, a first exhaust passage communicating with said first exhaust outlet, an exhaust outlet port, and a second exhaust passage located wholly within said engine block member, communicating between said exhaust inlet port and said exhaust outlet port, and including an interior portion having an area greater than the area of said exhaust inlet port.

18. A marine propulsion device comprising a lower unit including a high-speed exhaust outlet and a rotatably mounted propeller, a generally vertical conduit communicating with said high-speed exhaust outlet, wall means surrounding said conduit and defining a water jacket between said wall means and said conduit, said water jacket including a lower portion adapted to be filled with water, and an exhaust inlet, and an engine drivingly connected to said propeller and comprising an engine block member including a lower face connected to said lower unit, said lower face having therein a first exhaust outlet communicating with said conduit and with said water jacket exhaust inlet, and an exhaust inlet portion having an area and communicating with said water jacket at a point above the level of the water in said water jacket, a first exhaust passage communicating with said first exhaust outlet and including opposite sides, an exhaust outlet port, and a second exhaust passage communicating between said exhaust inlet port and said exhaust outlet port and including first and second branches extending respectively on said opposite sides of said first passage, and an interior portion having an area greater than the area of said exhaust inlet port.

19. A marine propulsion device comprising a lower unit including a high-speed exhaust outlet, a generally vertical conduit communicating with said high-speed exhaust outlet, wall means surrounding said conduit and defining a water jacket between said wall means and said conduit, said water jacket including a lower portion adapted to be filled with water, and an exhaust inlet, and an engine comprising an engine block member including a lower face connected to said lower unit, said lower face having therein a first exhaust outlet communicating with said conduit and with said water jacket exhaust inlet, and said engine block member also including muffler means including an exhaust inlet port located in said lower face forwardly of said first exhaust outlet and communicating with said water jacket at a point above the level of the water in said water jacket, an exhaust outlet port, and a passage communicating between said exhaust inlet port and said exhaust outlet port and having therein an expansion chamber.

20. A marine propulsion device comprising a lower unit including a high-speed exhaust outlet and a rotatably mounted propeller, a generally vertical conduit communicating with said high-speed exhaust outlet, wall means surrounding said conduit and defining a water jacket between said wall means and said conduit, said water jacket including a lower portion adapted to be filled with water, and an exhaust gas inlet, and an engine drivingly connected to said propeller and comprising an engine block member including a lower face connected to said lower unit and having therein a first exhaust outlet communicating with said conduit and with said water jacket exhaust gas inlet, said engine block member also including a first exhaust passage communicating with said first exhaust outlet and including opposite sides, and said engine block member also including muffler means including an exhaust inlet port located in said lower face and communicating with said water jacket at a point above the level of the water in said water jacket, an exhaust outlet port, and a second passage communicating between said exhaust inlet port and said exhaust outlet port and including first and second branches extending on said opposite sides of said first passage, and said second passage having therein an expansion chamber.

* * * * *